United States Patent [19]

Koenig

[11] Patent Number: 4,763,787

[45] Date of Patent: Aug. 16, 1988

[54] PACKAGE ASSEMBLY

[75] Inventor: David G. Koenig, Reynoldsburg, Ohio

[73] Assignee: Owens-Illinois Television Products Inc., Toledo, Ohio

[21] Appl. No.: 869,639

[22] Filed: Jun. 2, 1986

[51] Int. Cl.[4] ..... B65D 85/42

[52] U.S. Cl. ..... 206/420; 206/421; 206/418; 206/600; 206/501; 206/503; 206/516; 206/821

[58] Field of Search ..... 206/418, 421, 420, 600, 206/503, 515, 516, 501, 821; 229/2.5 EC

[56] References Cited

U.S. PATENT DOCUMENTS

| | | | |
|---|---|---|---|
| 3,637,073 | 1/1972 | Capuano | 206/503 |
| 3,655,110 | 4/1972 | Eisenbach | 229/2.5 EC |
| 3,771,712 | 11/1973 | Richards | 229/2.5 EC |
| 3,961,707 | 6/1976 | Lehr et al. | 206/419 |
| 4,088,225 | 5/1978 | Hartnell | 206/419 |
| 4,386,702 | 6/1983 | Schultz et al. | 206/591 |
| 4,391,371 | 7/1983 | Sieffert | 206/419 |

*Primary Examiner*—Joseph M. Moy

[57] ABSTRACT

A package assembly includes a pallet, an outer shell supported on the pallet, and a plurality of inner cells disposed within the outer shell. A plurality of package elements are utilized to separate and support a stack of video glass funnel parts within each inner cell. The upper pyramidal surface of a package element has step means formed therein for receiving and supporting the edge of a larger end of a glass funnel part, while a lower surface of the pyramidal element is configured to receive and mate with upper surfaces of the contoured sides of a glass funnel part. Stiffening support posts may be disposed in the corners of the inner cells. A cover has a top panel and downwardly depending side walls which extend around the upper edges of the sides of the outer shell.

20 Claims, 4 Drawing Sheets

PACKAGE ASSEMBLY

BACKGROUND OF THE INVENTION

1. Field of the Invention

This invention relates generally to package assemblies and, more specifically, to packages or containers which are particularly useful for shipping glass components of video bulbs in the embodiment shown herein. The invention is also directed toward providing a collapsible partitioned corrugated container, which can be returned to the shipper for reuse.

2. Description of the Prior Art

The manufacture of television tubes is generally accomplished in two different plants, requiring the shipment of the glass component parts of the television tube from the component producing plant to a television tube or bulb assembly plant. In the past the component producing plant manufactured a glass funnel having a relatively large, generally rectangular viewing end portion, to which a face plate is eventually integrally attached, and which tapered toward the other end down to a throat to which a neck tube was integrally attached.

A variety of special packages or containers, either corrugated or plastic or combinations thereof, have been disclosed in the prior art for shipping these unusually shaped glass components. Examples of these special packages are found in U.S. Pat. Nos. 4,294,359; 4,278,170; 4,088,225; 3,961,707; 3,930,579 and 3,494,535.

Recently, the manufacture of television tubes has changed in that the neck tube may now be attached to the tapered end of the funnel component at the bulb assembly plant, where the face plate is then secured to the funnel and electronic components are inserted into the neck tube. This, then, requires new methods and approaches for packaging the "neckless" funnels to conserve shipping space. It also offers an opportunity to provide packaging which can be collapsed and returned to the funnel shipper for reuse to reduce costs. Further, it has been found possible to design such packaging which not only meets the requirements for shipping delicate glass components, but which also may be used for generic packaging of a number of other products.

Many reusable packages or containers have been disclosed in the prior art, with U.S. Pat. Nos. 4,454,946; 4,040,558 and 4,037,775 being examples that illustrate types of packaging assemblies which are most closely related to the invention herein. However, these containers are not suitable for the unique and burdensome shipping and storage problems encountered with glass components for television bulbs. These components are massive, yet extremely fragile. Not only must the components be protected from harm during the actual shipment, but the containers must be stackable to heights which can best utilize both warehouse and transport vehicle space. Collapse of stacked containers causes damage to the containers and often to their fragile contents.

In designing package assemblies to satisfy the requirements noted above the first priority is to conserve shipping space to reduce transportation costs. The conservation of space then increases the glass density in the pack thereby substantially increasing the weight of the pack. This, then, adds the requirement of greater package strength to avoid rupture and other package damage and/or damage to the contents. Moreover, the increased weight requires design features that will ensure stability of the package and permit warehouse and shipping stacking.

It is important to design a package assembly which utilizes the least expensive materials while maintaining performance and functional characteristics discussed above. In addition, the shipping costs can be reduced further if the packaging materials can be returned to the shipper for reuse. Finally, if the package assembly components can be collapsed and/or returned to the shipper in a manner that occupies the least possible space, further incremental cost reductions can be achieved. None of the prior art known to applicant can provide all of these necessary features.

SUMMARY OF THE INVENTION

A package assembly particularly useful for shipping a plurality of video glass funnel parts is disclosed. These glass funnels have a larger end for attachment of a face plate thereto and a smaller end for attachment of a neck tube. Contoured sides of a funnel taper from the large end to the small end.

The assembly includes a pallet, an outer shell, and a plurality of inner cells. The outer shell has four vertical sides and is positionable to be supported on the pallet. The inner cells are positionable within the outer shell and are each sized to receive a stack of video glass funnels within its four vertical walls.

A plurality of packaging elements are used for supporting and separating video glass funnels stacked in an inner cell. Each packaging element has an apex section, a base rim which is larger than and spaced from the apex section, and a plurality of sloping ribs extending from the base rim to the apex section and defining a generally pyramidal form.

Each of the ribs of a packaging element have a step formed therein for receiving the edge of a larger end of a glass funnel to support the glass part on top of the packaging element. A web means extends between and connects the ribs. The web means has lower surfaces that are configured to receive and mate with upper surfaces of contoured sides of a glass funnel part to enable a packaging element to nest on top of a glass funnel part.

A cover member is provided, which has a top panel and side walls extending downwardly therefrom which fit around the outside of the vertical sides of the outer shell. Stiffening members may be disposed in the corners of the inner cells to provide a downward compression resistance.

The object of this invention is to provide an improved package assembly.

It is a further object of this invention to provide an improved package assembly for shipping neckless glass funnel parts for video bulbs.

It is a still further object of this invention to provide an improved packaging element for supporting and separating individual glass funnel parts in a stack of such parts.

Other objects, advantages and features of this invention will become more apparent during the course of the following description when it is read in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENT

Figure 1:
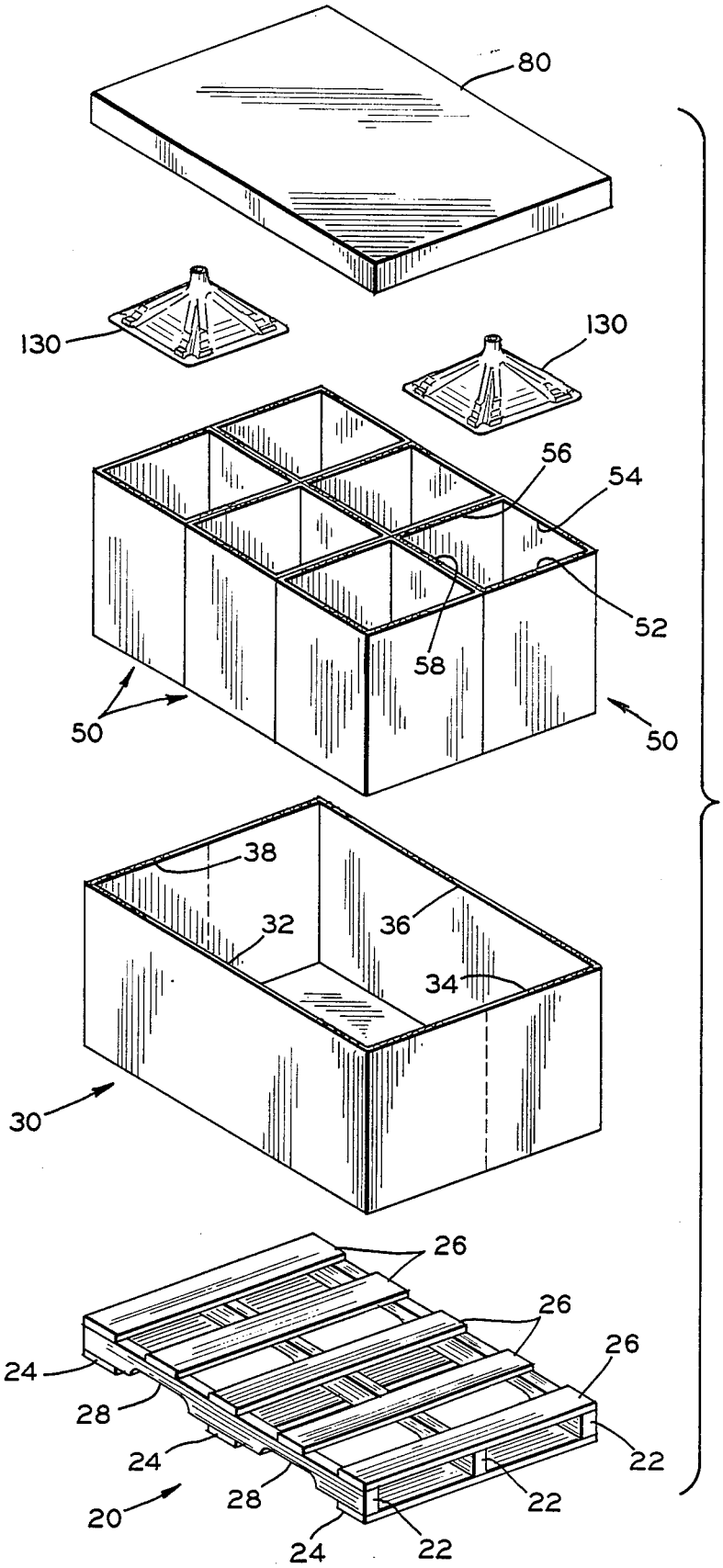
FIG. 1 illustrates an embodiment of the invention in a perspective view with the component parts in an exploded position to show their relative assembly positions.

Referring now to FIG. 1 there is illustrated an embodiment of the teachings of this invention shown in a perspective, exploded view.

A pallet means 20 includes a plurality of parallel spacer supports 22. Lower deck slats 24 and upper deck slats 26 are transversly secured to the spacer supports 22 to provide a support platform for the package assembly. Grooves 28 are formed in the lower edges of spacer supports 22 to receive fork lift tongs for moving the pallet 20.

Figure 2:
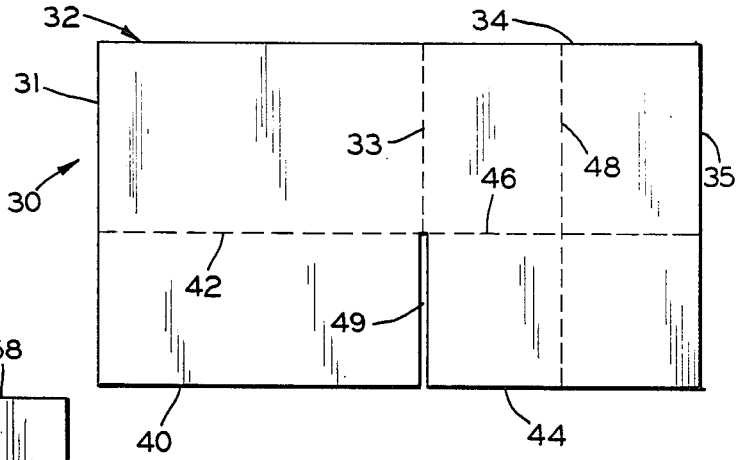
FIG. 2 is a plan view of a production blank for one-half of a two piece outer shell component.

An outer shell 30 includes vertical side wall panels 32, 34, 36 and 38 and is positionable in the open position shown on the pallet 20. A production blank of corrugated paperboard is shown.in FIG. 2 for constructing an outer shell 30. Because the outer shell is large it is preferably constructed as a two piece box, with the blank for one half of the box shown in a plan view in FIG. 2.

A score line 33 between side walls 32 and 34 enables folding of the blank to form one half of the outer shell 30. Edges 31 and 35 of walls 32 and 34 are serially joined to corresponding walls 38 and 36, respectively of a similar blank by tape or other suitable means.

Bottom flaps 40 and 44 are integrally hinged to the bottom of side walls 32 and 34 along score lines 42 and 46. Slot 49 is formed in the blank between bottom flaps 40, 44 to aid in easing the folding of the bottom flaps inwardly to form a bottom for the outer shell 30. These bottom flaps cooperate with corresponding bottom flaps integrally hinged to side walls 36 and 38 to form a bottom which improves the dimensional stability and strength of the outer shell 30.

Referring again to FIG. 1 there is shown a plurality (six in this embodiment) of inner cells 50 which are positionable within the outer shell 30. Each cell is sized to receive a stack of frangible parts, in this instance video glass funnel parts without neck tubes attached.

Figure 3:
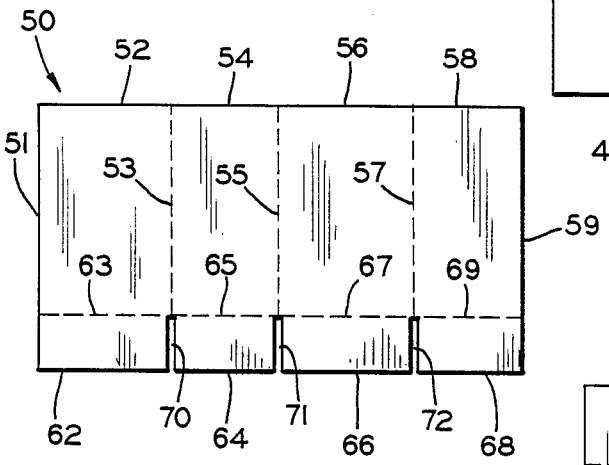
FIG. 3 is a plan view of a production blank for an inner cell component.

A production blank for formation of an inner cell 50 is shown in plan in FIG. 3. Four cell wall panels 52, 54, 56 and 58 are serially joined at score lines 53, 55, 57 and by tape or other means at wall edges 51, 59. Bottom flaps 62, 64, 66 and 68 are integrally hinged to the bottom of wall panels 52, 54, 56 and 58 along score lines 63, 65, 67 and 69. Slots 70, 71 and 72 between flaps 62, 64 and 64, 66 and 66, 68 aid in folding the flaps inwardly to form a bottom for an inner cell 50 to improve the dimensional stability and strength of the inner cell 50.

As shown in FIG. 1 a plurality of packaging elements 130 are used in each inner cell 50 to support and separate each frangible part from each other in the stack of such parts in each inner cell. These will be described in more detail later.

A cover member 80 fits over the top of outer shell 30 to prevent debris from enterin9 inner cells 50, to provide dimensional stability to the upper portions of outer shell 30 and inner cells 50, and to enable the use of tautly drawn bands of metal or plastic encircling the package assembly components.

Figure 7:
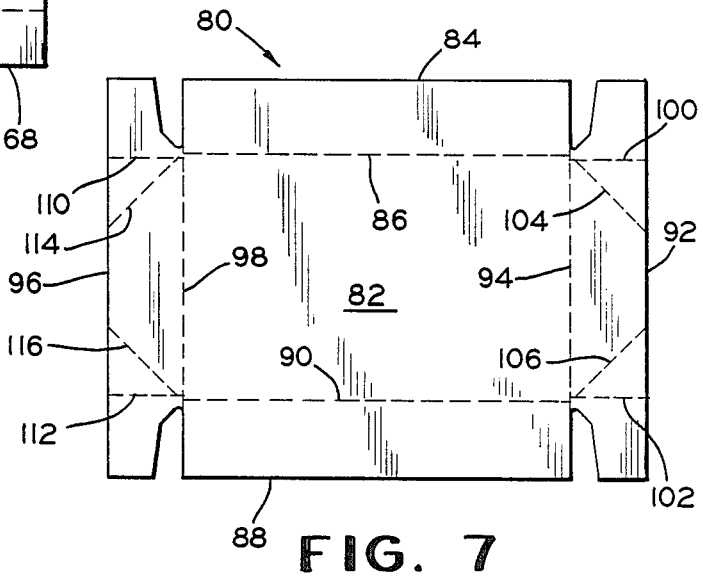
FIG. 7 is a plan view of a production blank for a top cover for the outer shell of the package assembly.

Referring to FIG. 7, there is shown a production blank for formation of a cover member 80. A top panel 82 has side wall flaps 84 and 88 integrally hinged to the panel 82 along score lines 86 and 90, respectively. End wall flaps 92 and 96 are integrally hinged to panel 82 along score lines 94 and 98, respectively. The side and end wall flaps are folded to a position which is perpendicular with respect to top panel 82. The extremities of end wall flaps 92 and 96 are then folded inwardly to a perpendicular position with respect to the end walls along score lines 100, 102 and 110, 112, respectively, and glued or stapled or otherwise secured to the side wall flaps. This then forms a cover member having a top panel and walls extending downwardly therefrom which fit around the outside of the vertical sides of the outer shell. Encircling bands around the components of the package assembly will advantageously wrap the components into an integrated structure with improved stacking and handling characteristics.

The production blank will also advantageously have score lines 104, 106 and 114, 116 formed in the end wall flaps 92 and 96, respectively, which extend diagonally from each corner intersection of wall flaps and the top panel. This enables folding of opposed wall flaps inwardly adjacent the top panel and the folding of the remaining wall flaps inwardly on top of the first opposed pair to compact the cover member 80 for shipping and handling, whether in initial production or in shipping for reuse.

Figure 4:
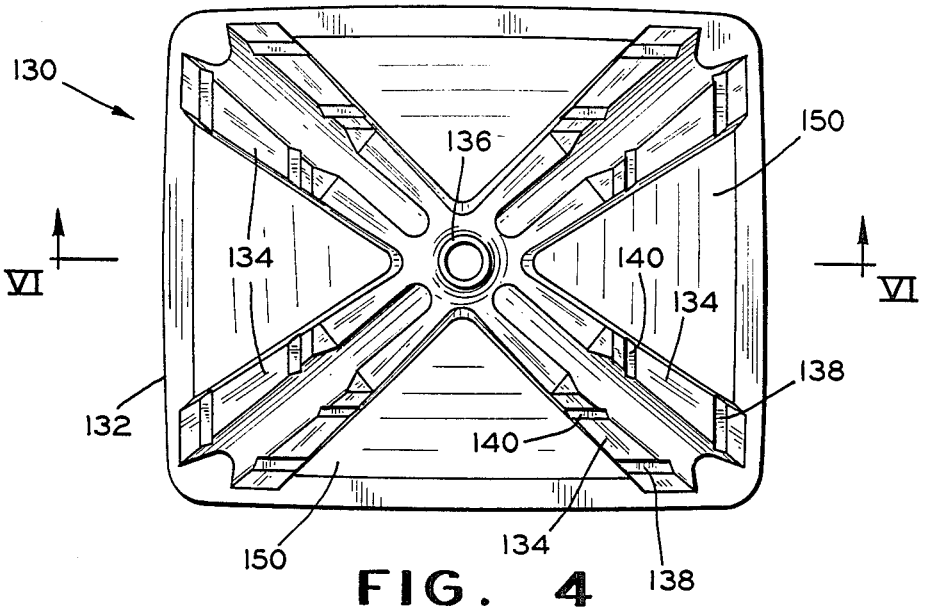
FIG. 4 is a plan view of a packaging element for supporting and separating glass funnel parts in a stack of such parts.
Figure 5:
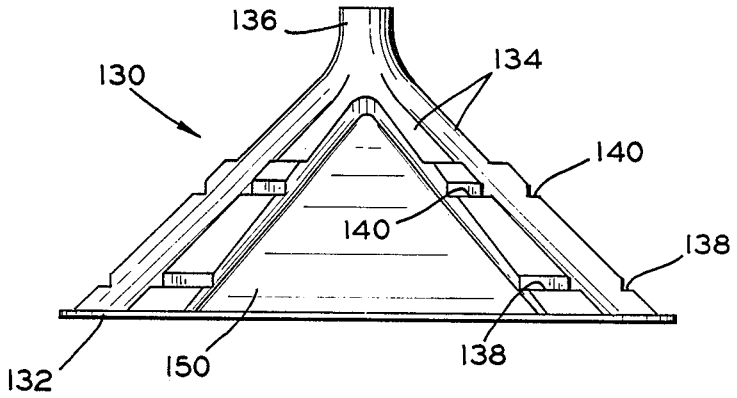
FIG. 5 is a side elevational view of the packaging element illustrated in FIG. 4.
Figure 6:
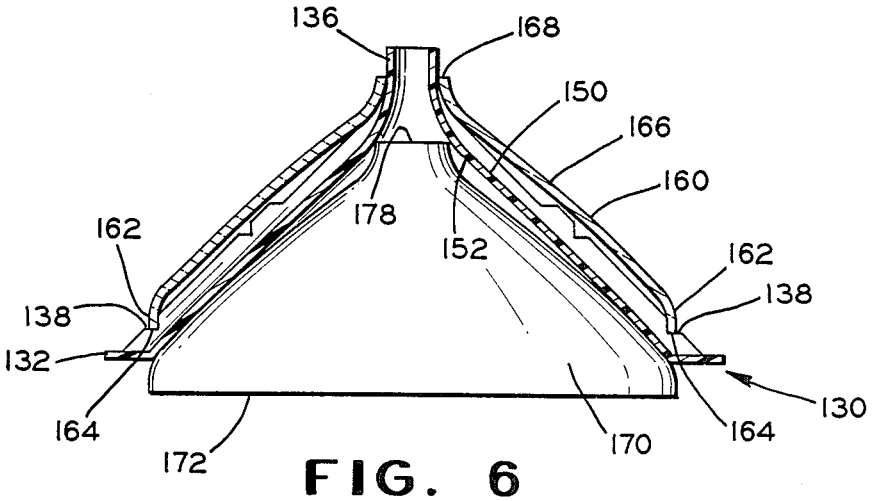
FIG. 6 is a cross-sectional view of the packaging element taken along lines VI—VI in FIG. 4, showing support of a glass funnel part (in section) on top of the packaging element and the nesting of a second glass funnel part against the lower surfaces of the packaging elements.

Referring now to FIGS. 4, 5 and 6, the packaging element 130 is shown in greater detail in plan, side elevational and cross-sectional views. The packaging element is provided for supporting and separating individual or layers of frangible parts in each stack of such parts in an inner cell 50.

Each such frangible part can be generically described as having a generally bowl-shaped configuration with contoured sides tapering from the edge of a larger open end toward a smaller end. In the specific application involved in this embodiment of the invention, the frangible parts are video glass funnel parts without a neck tube. Each such glass part has a larger end with an edge around the opening thereof which describes a generally rectangular land for attaching a mating generally rectangular edge of a face plate thereto. A smaller end of the glass funnel has a generally circular edge around the opening therein for attachment of a neck tube thereto. Contoured sides of the glass funnel taper from the larger end to the smaller end.

In FIGS. 4, 5 and 6, there is illustrated a packaging element 130 which has an apex section 136, a base rim 132 which is larger than and spaced from the apex section, and a plurality of sloping ribs 134 which extend from the base rim 132 to the apex section 136. The ribs 134 define a generally pyramidal, cone, or bowl shape or form which is designed to fit into the interior of a bowl-shaped part or video glass funnel.

The ribs 134 have a first series of steps 138 formed in the upper surface thereof for receiving and supporting the edge 164 of a larger end 162 (see FIG. 6) of a glass funnel part 160. The steps 134 are formed at the same distance from the base rim 132 to maintain the glass funnel substantially level so that verticality of a stack of such funnels and packaging elements may be maintained. A second series of such steps 140 are formed in the upper surfaces of ribs 134, at a greater distance from the base 132 further up the sloping ribs, to accommodate a smaller glass funnel which has a relatively smaller open end than the funnel 160 shown in FIG. 6.

The elements 130 have web means 150 extending between and connecting the lower edges of ribs 134. The webs 150 have lower surfaces 152 configured to receive and mate with upper surfaces 166 of the contoured sides which taper from the large end 162 to the small end 168 of the funnel. (See FIG. 6).

Each of the rib steps 138, 140 has a horizontal wall for receiving the edge 164 of a funnel, and a vertical wall. The ribs and steps formed therein are spaced far enough apart so that the substantially vertical walls of the steps engage an inside surface of the glass funnel part to substantially prevent lateral movement of a glass funnel part resting on the horizontal walls of the steps.

As can be best seen in FIG. 6, the apex section 136 has an initially cylindrical shape which merges into the pyramidal or cone shape defined by the ribs and connecting webs. The apex section extends upwardly through the smaller end 168 of a glass funnel part to cooperate with another apex section stacked thereon to act as a stacking guide and to provide vertical stability to a stack of glass funnel parts and packaging elements. Moreover, the upper end of the apex section can be extended so that it bears against the inside of an apex section of a second, loaded packaging element stacked thereon to enable the packaging elements to directly bear some of the compression load of a stack.

The packaging elements are preferably molded or formed from synthetic plastic materials, thereby providing additional resiliency to the rib and web construction to absorb shock and compression forces, yet returning from deformation caused by such forces to permit reuse again and again. Since the upper surface of the element does not contact the lower surface of a funnel, room is provided for spring action to absorb shock. In a preferred form the packaging element is formed from high density polyethylene with a thickness of 0.08 inches.

Figure 8:
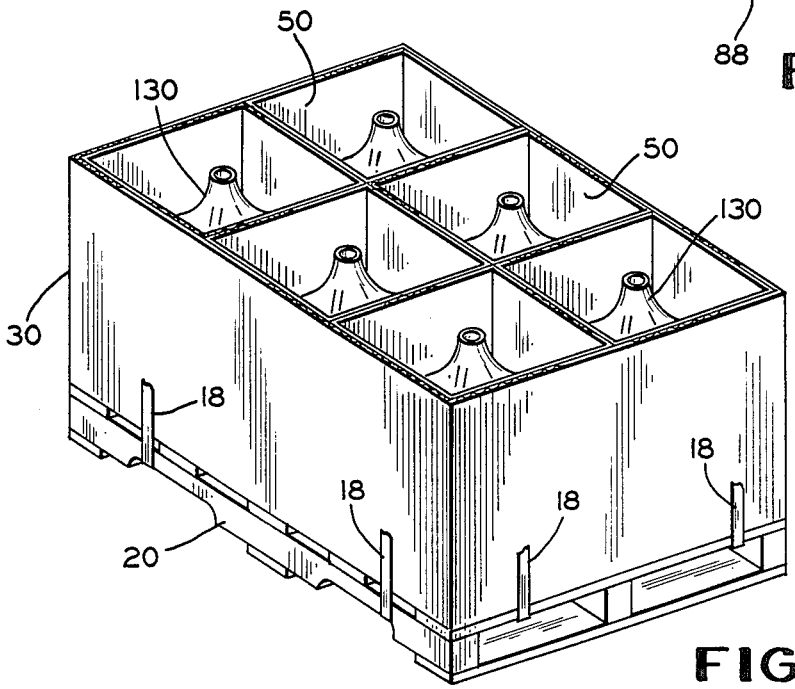
FIG. 8 is a view in perspective illustrating an outer shell having a plurality of inner cells positioned therein, with a stack of packaging elements in each inner cell.

Referring now to FIG. 8 there is illustrated a view in perspective of an outer shell 30 supported on a pallet 20, with a plurality of inner cells 50 positioned in outer shell 30 and stacks of funnels and packaging elements 130 in each inner cell 50. A plurality of encircling bands 18 are illustrated in part. In a complete assembly the cover member 80 would be placed over the top of outer shell 30 and the bands 18 continued up over the top of cover 80 to completely encircle the components and wrap them into an integrated unit.

Figure 9:
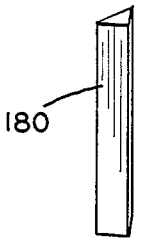
FIG. 9 is a view in perspective of a stiffening member which may be disposed in corners of the inner cells.
Figure 10:
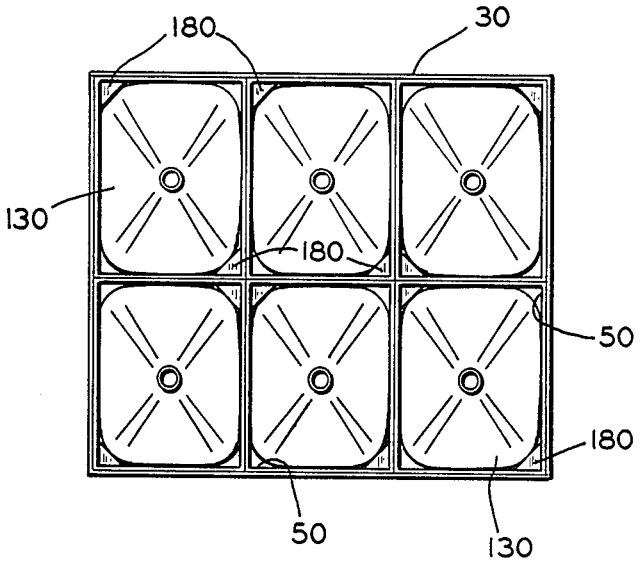
FIG. 10 is a plan view of the combination illustrated in FIG. 8 showing the relative dispositions of stiffening members in the corners of inner cells as held in place by the packaging elements.

FIG. 9 illustrates a stiffening member or corner post 180. The posts 180 may be formed from wood, plastic or other material that will withstand the compression forces on the package that occur when the package assemblies are stacked several units high. The posts 180 are individual units that are preferably not attached to the inner cells 50, but are held in place in the corners of cells 50 by the urging of the base rims 132 of the packaging elements 130. This is best seen in FIG. 10 which is a plan view of the assembly as illustrated in FIG. 8. While adequate compression resistance may be obtained by disposing the posts 180 in the corners of inner cells 50 that are disposed in the four corners of the outer shell 30, it is preferable to dispose a post in each of the opposite corners of each inner cell 50 as shown in FIG. 10. It is further advantageous to select the opposed corners of the inner cells 50 so that there are at least three posts adjacent to each other along the center line and in the middle of the outer shell 30 as shown in FIG. 10. The posts 180 preferably have a substantially triangular cross-section to enable the right angle of the triangle to nest in the corner of a cell 50, while the hypotenuse of the triangle is engaged by the base rims 132.

Figure 11:
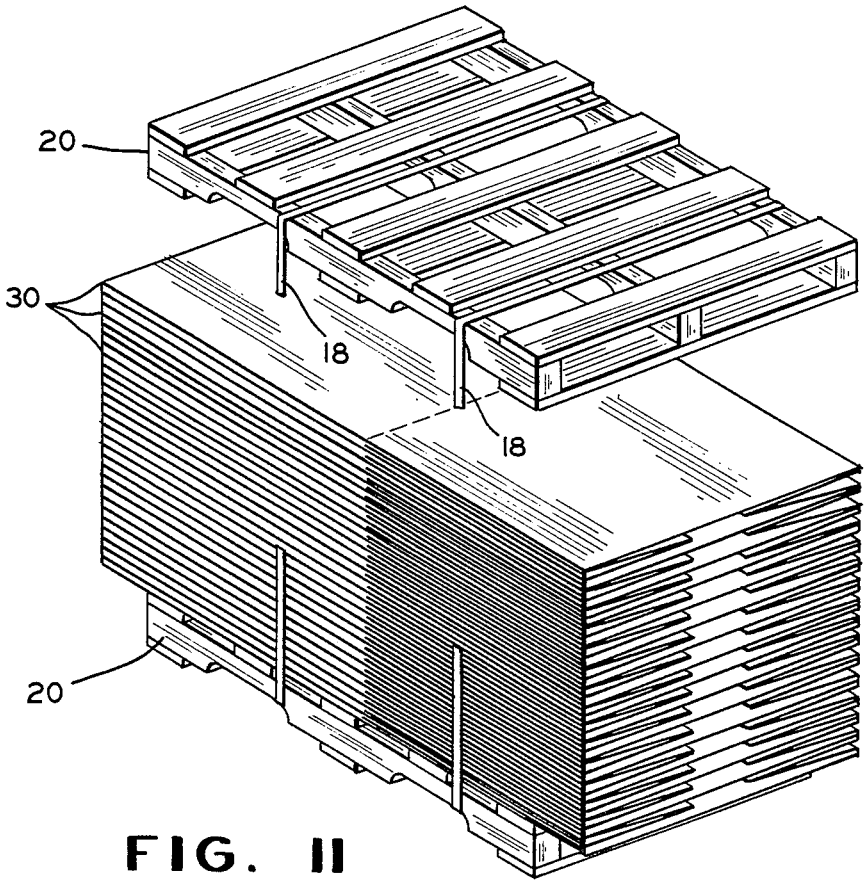
FIG. 11 is a view in perspective of a plurality of collapsed outer shells stacked on a pallet for return to a shipper for reuse.

The outer shell 30, inner cells 50 and cover member 80 may be formed of relatively inexpensive corrugated paperboard, since the novel assembly, including the packaging elements 130 and pallet 20, has strength and stability for the high density glass pack and heavy weight that might normally require more expensive packaging materials. This allows costs to be reduced substantially. Further, the assembly has been designed so that the components can be readily collapsed, stacked, etc. for return to the original shipper for reuse. For example, the packaging elements 130 may be nested on top of each other in stacks and returned in an outer shell 30/inner cells 50 combination that has been left assembled as shown in FIG. 8. One or more of the inner cells 50 may be used to return a substantial number of the stiffening posts 180. A second pallet 20 may be placed on top of the combination shown in FIG. 8 to serve as a top cover, while also returning the pack. Encircling bands 18 may be used to tie such a combination together into an integrated unit for return to the original shipper. Referring now to FIG. 11, there is illustrated a method of returning a plurality of the outer shells 30 to the original shipper. As noted in FIG. 2, an additional score line 48 has been formed vertically down the center of the opposed sides 34, 38, and through the center of the attached bottom flaps as well. When an outer shell 30 is emptied the bottom flaps may be returned to the same plane as the vertical sides to which they are attached. The opposed sides and bottom flaps that have the score lines 48 formed therein are then pushed toward each other along the score lines 48. As those opposed sides approach each other, with the score lines 48 leading the way, the remaining pair of vertical sides and attached bottom flaps move toward each in their flap position. Each outer shell is thus collapsed in an accordion fashion for return to the original shipper as illustrated in FIG. 11.

As noted in FIG. 11, the outer shell and pallet combination are advantageously designed so that the length of vertical sides which do not have score lines 48 formed therein is substantially the same as the width of the pallet. This enables the stacking of collapsed outer shells on a pallet in a manner which prevents shipping damage to the serially joined edges of the wall panels, yet permits maximum storage volume within an outer shell when set up in an open position on a pallet. A second pallet may be placed on top of the stack of collapsed outer shells, and encircling bands 18 used to tie the materials into an integral unit for shipping.

Similarly, each inner cell 50 may have the bottom flaps returned to their original position in the same plane as their respective side walls. The inner cells are then collapsed to a flattened position with sides 52, 54 on top of sides 56, 58, along with their respective bottom flaps. A stack of such collapsed inner cells may be positioned on a pallet in the same manner as described above for the outer shells.

It is to be understood that the form of the invention shown and described herein is to be taken as an illustrative embodiment only, and that various changes in the shape, size and arrangement of the parts may be made without departing from the spirit and scope of the invention.

I claim:

1. A packaging element for supporting and separating layers of video glass funnel parts, wherein each glass part has a larger end for attachment of a face plate thereto and a smaller end for attachment of a neck tube and with contoured sides tapering from said larger end to said smaller end, comprising:

(a) an apex section, (b) a base rim which is larger than and spaced from said apex section, (c) a plurality of sloping ribs extending from said base rim to said apex section and defining a generally pyramidal form, each of said ribs having spaced innermost edges, and an outermost upper surface spaced from innermost edges, (d) each of said ribs having a step formed in said upper surface thereof for receiving and supporting the edge of a larger end of a glass funnel part, all of said steps in said ribs being formed at the same distance from said base rim and being spaced from said innermost edges to provide shock absorbing for a funnel part supported thereon, and (e) web means extending between said innermost edges of said ribs and connecting said ribs, said web means having lower surfaces configured to receive and mate with upper surfaces of contoured sides which connect a larger end to a smaller end of a glass funnel part, (f) the rib steps and the lower mating surfaces of said webs of the packaging element enabling the stacking of a plurality of glass funnel parts by the use of the package elements therebetween to protect the glass funnel parts from shock and compression forces.

2. A packaging element as defined in claim 1 in which (a) each of said rib steps has a horizontal wall and a substantially vertical wall, and in which (b) said ribs are spaced apart so that when the horizontal walls of the steps support an attachment edge of a large end of a glass funnel part the substantially vertical walls of the steps engage an inside surface of a glass funnel part to substantially prevent lateral movement of a glass funnel part resting on said horizontal walls of said steps.

3. A packaging element as defined in claim 1 in which said apex section extends upwardly through the smaller end of a glass funnel part to cooperate with the inside of another apex section stacked thereon to act as a stacking guide and to provide vertical stability to a stack of glass funnel parts and packaging elements.

4. A packaging element as defined in claim 1 in which the apex section extends upwardly through and engages the inside surface of the smaller end of a glass funnel part, to provide support to and resist lateral movement of a glass funnel part resting on a package element.

5. A packaging element as defined in claim 1 which further includes a second series of steps formed in said upper surfaces of said plurality of ribs for receiving and supporting the edge of a larger end of a glass funnel part which is a different size than that accommodated by said first mentioned steps in said ribs thereby enabling use of said packaging elements with different sizes of glass funnel parts, said second series of steps also being spaced from the innermost edges of said ribs to provide shock absorbing for a funnel part supported thereon.

6. A package assembly for shipping a plurality of video glass funnel parts, wherein each glass part has a larger end for attachment of a face plate thereto and a smaller end for attachment of a neck tube and with contoured sides tapered from the larger end to the smaller end, comprising;

(a) pallet means for supporting parts, (b) an outer shell having four vertical sides positionable to be supported on said pallel means, (c) a plurality of inner cells positionable within said outer shell, each cell having four vertical walls and sized to receive a stack of video glass funnel parts, and (d) a plurality of packaging elements for supporting and separating video glass funnel parts stacked in an inner cell, (e) each of said packaging elements having an apex section, a base rim which is larger than and spaced from said apex section, and a plurality of sloping ribs extending from said base rim to said apex section defining a generally pyramidal form, each of said ribs having spaced innermost edges and an outermost upper surface spaced from said innermost edges, (f) each of said ribs of a packaging element having a step formed in said upper surface thereof for receiving the edge of a larger end of a glass funnel part to support such glass part on top of a packaging element, all of said steps in said ribs being formed at the same distance from said base rim and being spaced from said innermost edges to provide shock absorbing for a glass part supproted thereon, (g) each of said packaging elements having a web means extending between said innermost edges of said ribs and connecting the ribs, said web means having lower surfaces configured to receive and mate with upper surfaces of contoured sides of a glass funnel part thereby enabling a packaging element to nest on top of a glass funnel part.

7. A package assembly as defined in claim 6 which further includes a cover member having a top panel and side walls extending downwardly therefrom which fit around the outside of said vertical sides of said outer shell, thereby enabling the use of one or more tautly drawn bands encircling said package assembly to wrap the components into an integrated structure which may be easily stacked with other such integrated structures or individually handled in the shipping process.

8. A package assembly as defined in claim 6 which further includes stiffening members for the corners of said inner cells to provide downward compression resistance and stability to enable greater stacking heights of said package assemblies without injury to the contents.

9. A package assembly as defined in claim 8 in which said stiffening members are individual posts having a substantially triangular cross-section which enables them to fit in the corners of said inner cells and to be held in place by the base rims of said packaging elements.

10. A package assembly as defined in claim 9 in which individual posts are provided for the diagonally opposite corners of each inner cell.

11. A package assembly as defined in claim 6 which further includes, (a) a cover member having a top panel and side walls extending downwardly therefrom which fit around the outside of said vertical sides of said outer shell, and (b) stiffening members for the corners of said inner cells to provide downward compression resistance and stability, (c) said outer shell, inner cells and cover member being formed from relatively inexpensive corrugated paperboard, while the combination of package components provides the content protection and reuse characteristics of more expensive materials.

12. A collapsible and reusable package assembly for shipping a plurality of video glass funnel parts, wherein each glass part has a larger end for attachment of a face plate thereto and a smaller end for attachment of a neck tube and with contoured sides tapering from the larger end to the smaller end, comprising:

(a) pallet means for supporting parts, (b) an outer shell which is rectangular in cross-section and has four serially joined shell wall panels positionable to be suported on said pallet means, said outer shell being flattenable for shipping for reuse by pushing a pair of opposing shell wall panels together with folding taking place at diagonally opposed corners, (c) a plurality of inner cells positionable within said outer shell, each inner cell being rectangular in cross-section and having four serially joined cell wall panels, each inner cell being flattenable for shipping for reuse by pushing a pair of opposing cell wall panels together with folding taking place at diagonally opposed corners, each inenr cell being sized to receive a stack of video glass funnel parts, and (d) a plurality of pasckaging elements for supporting and separating video glass funnel parts stacked in an inner cell, (e) each of said packaging elements having an apex section, a base rim which is larger than said apex section, and a plurality of sloping ribs extending from said base rim to said apex section defining a generally pyramidal form, each of said ribs having spaced innermost edges and an outermost upper surface spaced from said innermost edges, (f) each of said ribs of said packaging element having a step formed in said upper surface thereof for receiving and supporting the edge of a larger end of a glass funnel part, all of said steps in said ribs being formed at the same distance from said base rim and being spaced from said innermost edges to provide shock absorbing for a glass part supported thereon, (g) each of said packaging elements having web means extending between said innermost edges of said ribs and connecting the ribs, said web means having lower surfaces configured to receive and mate with upper surfaces of contoured sides of a glass funnel part thereby enabling a packaging element to nest on top of a glass funnel part, (h) said packaging elements being nestable directly on top of each other for shipping for reuse.

13. A collapsible and reusable package assembly as defined in claim 12 in which two of the opposing wall panels of said outer shell are vertically scored, thereby permitting those opposed and scored wall panels to be folded inward toward each other along said score lines while the remaining two wall panels are kept flat and advanced toward each other, thus reducing the area occupied by the outer shell when it is in a fully flattened and collapsed condition.

14. A collapsible and reusable package assembly as defined in claim 13 in which the length of the non-scored wall panels of said outer shell is substantially the same as the width of said pallet, thereby enabling the stacking of collapsed outer shells on a pallet for return for reuse while preventing shipping damage to serially joined edges of said wall panels, yet permitting maximum storage volume within an outer shell when set up in an open position on a pallet.

15. A collapsible and reusable package assembly as defined in claim 13 which further includes, (a) four bottom flaps integrally hinged on the bottom edges of the respective four outer shell wall panels, said bottom flaps being foldable inwardly to cooperatively form a bottom for said outer shell to provide a more dimensionally stable and strong outer shell, (b) the opposing bottom flaps hinged to said vertically scored opposing shell wall panels also being vertically scored along the same line, thereby permitting those opposed and scored bottom flaps to also be folded inwardly toward each other along said score lines when the remaining two bottom flaps are kept flat and advanced toward each other.

16. A collapsible and reusable package assembly as defined in claim 12 which further includes four bottom flaps integrally hinged on the bottom edges of the respective four vertical walls of each inner cell, said bottom flaps being foldable inwardly to cooperatively form a bottom for each inner cell to provide a more dimensionally stable and strong inner cell, the positioning of a plurality of such dimensionally stable inner cells within said outer shell thereby also improving the dimensional stability and strength of the overall combination of components.

17. A collapsible and reusable package assembly as defined in claim 12 which further includes a cover member having a top panel and side walls extending downwardly therefrom which fit around the outside of said vertical sides of said outer shell, thereby enabling the use of one or more tautly drawn bands encircling said package assembly to wrap the components into an integrated structure with improved stacking and handling characteristics, an opposed pair of said side walls of said cover member having score lines extending diagonally from each corner intersection of side walls and top panel to enable folding of said opposed pair of side walls inwardly adjacent said top panel and the folding of said remaining side walls inwardly on top of said opposed pair to compact the cover member for shipping.

18. A collapsible and reusable package assembly as defined in claim 17 which further includes, (a) stiffening members for the corners of said inner cells to provide downward compression resistance and stability, and in which (b) said outer shell, inner cells and cover members are formed of relatively inexpensive corrugated paperboard, while the combination of package components provides the content protection and reuse characteristics of more expensive materials.

19. A collapsible and reusable package assembly as defined in claim 12 which further includes post members having a substantially triangular cross-section which enables them to fit in the corners of said inner cells and to be held in place by the base members of said packaging elements to provide downward compression resistance and stability to enable greater stacking heights of package assemblies.

20. A collapsible and reusable package assembly as defined in claim 19 in which post members are provided for the diagonally opposite corners of each inner cell.

* * * * *